United States Patent [19]

Licari et al.

[11] Patent Number: 4,463,853

[45] Date of Patent: Aug. 7, 1984

[54] RACK FOR FOOTWEAR

[75] Inventors: Vito Licari; Yaffa Licari, both of Elberon, N.J.

[73] Assignee: Basic Line, Inc., Cliffwood Beach, N.J.

[21] Appl. No.: 281,035

[22] Filed: Jul. 7, 1981

[51] Int. Cl.[3] ..... A47F 7/08

[52] U.S. Cl. ..... 211/37; 211/189; 211/194

[58] Field of Search ..... 211/34, 189, 37, 38, 211/194; 248/163, 175, 188.1, 165; 108/91; 47/45, 47

[56] References Cited

U.S. PATENT DOCUMENTS

| | | | |
|---|---|---|---|
| 645,257 | 3/1900 | Greener | 248/163 R X |
| 952,603 | 3/1910 | Carroll | 211/199 |
| 1,927,569 | 9/1933 | Kuert . | |
| 1,961,870 | 6/1934 | Weston | 211/37 |
| 2,000,915 | 5/1935 | Blake . | |
| 2,293,275 | 8/1942 | Boltz | 211/199 X |
| 2,314,762 | 3/1943 | Boltz | 211/199 |
| 2,695,106 | 11/1954 | Cohen | 211/38 |
| 2,756,541 | 7/1956 | Berger | 47/45 X |
| 2,815,862 | 12/1957 | Einhorn . | |
| 2,845,182 | 7/1958 | Atkinson . | |
| 2,928,549 | 3/1960 | Neuwirth . | |
| 2,943,741 | 7/1960 | Atkinson . | |
| 2,969,155 | 1/1961 | Atkinson . | |
| 2,989,188 | 6/1961 | Auer et al. . | |
| 3,061,108 | 10/1962 | Duggan | 211/37 |
| 3,139,185 | 6/1964 | Wentz | 211/14 |
| 3,587,865 | 6/1971 | Phillips . | |
| 3,638,814 | 2/1972 | Lowery | 248/165 X |
| 3,888,353 | 6/1975 | Leifhut . | |
| 3,913,745 | 10/1975 | Weiss . | |
| 3,967,734 | 7/1976 | Morgan | 211/199 |
| 4,029,211 | 6/1977 | Marshall | 211/199 X |

FOREIGN PATENT DOCUMENTS

| | | |
|---|---|---|
| 2739414 | 2/1979 | Fed. Rep. of Germany . |

*Primary Examiner*—Ramon S. Britts
*Assistant Examiner*—Robert W. Gibson, Jr.
*Attorney, Agent, or Firm*—Lerner, David, Littenberg, Krumholz & Mentlik

[57] ABSTRACT

A stackable rack for footwear is made from a plurality of identical frame members. Each of the frame members has its own integral connectors for interconnecting the individual frame members to form the rack.

33 Claims, 5 Drawing Figures

RACK FOR FOOTWEAR

FIELD OF THE INVENTION

The present invention relates to storage racks, and, more particularly, to such racks which are especially adapted to store footwear, such as shoes, scandals, sneakers, and slippers.

BACKGROUND OF THE INVENTION

In the past, racks for footwear have been made from numerous parts and pieces which are usually connected by separate fastening devices, such as screws and bolts. Because of the numerous parts and pieces which make up these prior art racks, the racks can be expensive to manufacture and time-consuming to assemble. The purchase price of these racks to the consumer can be so high as to significantly limit the number of potential buyers.

Once assembled, many of the prior art racks are large and cumbersome, thereby restricting their use. Even though certain prior art racks have been designed to be compact, none of these racks is stackable so as to facilitate its display and transportation with other racks of the same type. Generally, increases in transportation expenses result in increases in the purchase price of the racks to the consumer, thereby limiting the number of potential buyers.

SUMMARY OF THE INVENTION

In accordance with one aspect of the present invention, there is provided a new and improved rack for footwear including an open-ended framework having a truncated shape and footwear hangers which do not project laterally inwardly or outwardly from the framework. The open-ended truncated shape and projection-free design of the rack permit it to be stacked on top of and over another identical rack, thereby facilitating display and transportation of the racks. The truncated shape is also advantageous because it increases the stability and strength of the rack by distributing its load over a relatively wide base. Thus, the size of the members constituting the framework can be reduced, resulting in lower construction costs. The lower construction and transportation costs result in a lower purchase price to the consumer, thereby increasing the number of potential buyers. The open-ended construction of the rack is also advantageous because it permits the hangers to be arranged such that footwear can be hung exteriorally and interiorally of the framework around substantially its entire periphery. By utilizing space inside and outside of the framework for storage purposes, the rack may be made compact. Furthermore, by utilizing substantially its entire periphery for storage purposes, the rack is capable of storing several pieces of footwear in spite of its compactness.

In accordance with another aspect of the present invention, the rack can be made from a plurality of identical prefabricated frame members to facilitate its manufacture and assembly. The manufacture and assembly of the rack are further facilitated by providing each frame member with its own monolithically formed connectors adapted to interconnect the various frame members, whereby the number of parts required to make the rack is reduced. Inasmuch as the manufacture and assembly of the rack are facilitated, the cost of constructing the rack is reduced. This reduction in construction costs results in a lower purchase price to the consumer, thereby increasing the number of potential buyers.

BRIEF DESCRIPTION OF THE DRAWINGS

For a more complete understanding of the present invention, reference may be had to the following description of the an exemplary embodiment taken in conjunction with the accompanying figures of the drawings, in which.

DESCRIPTION OF THE EXEMPLARY EMBODIMENT

Figure 1:
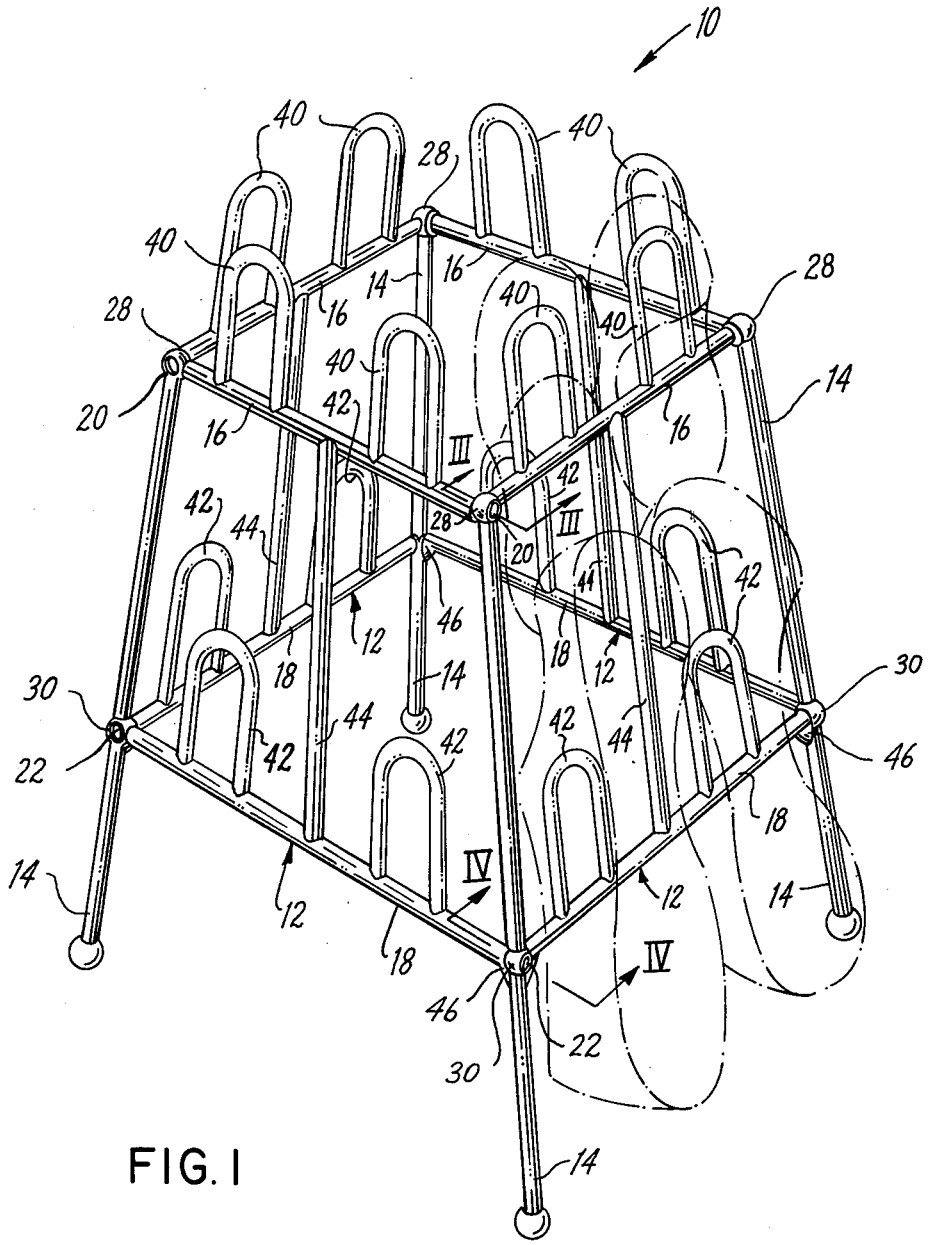
FIG. 1 is a perspective view of one embodiment of a footwear rack constructed in accordance with the present invention.
Figure 5:
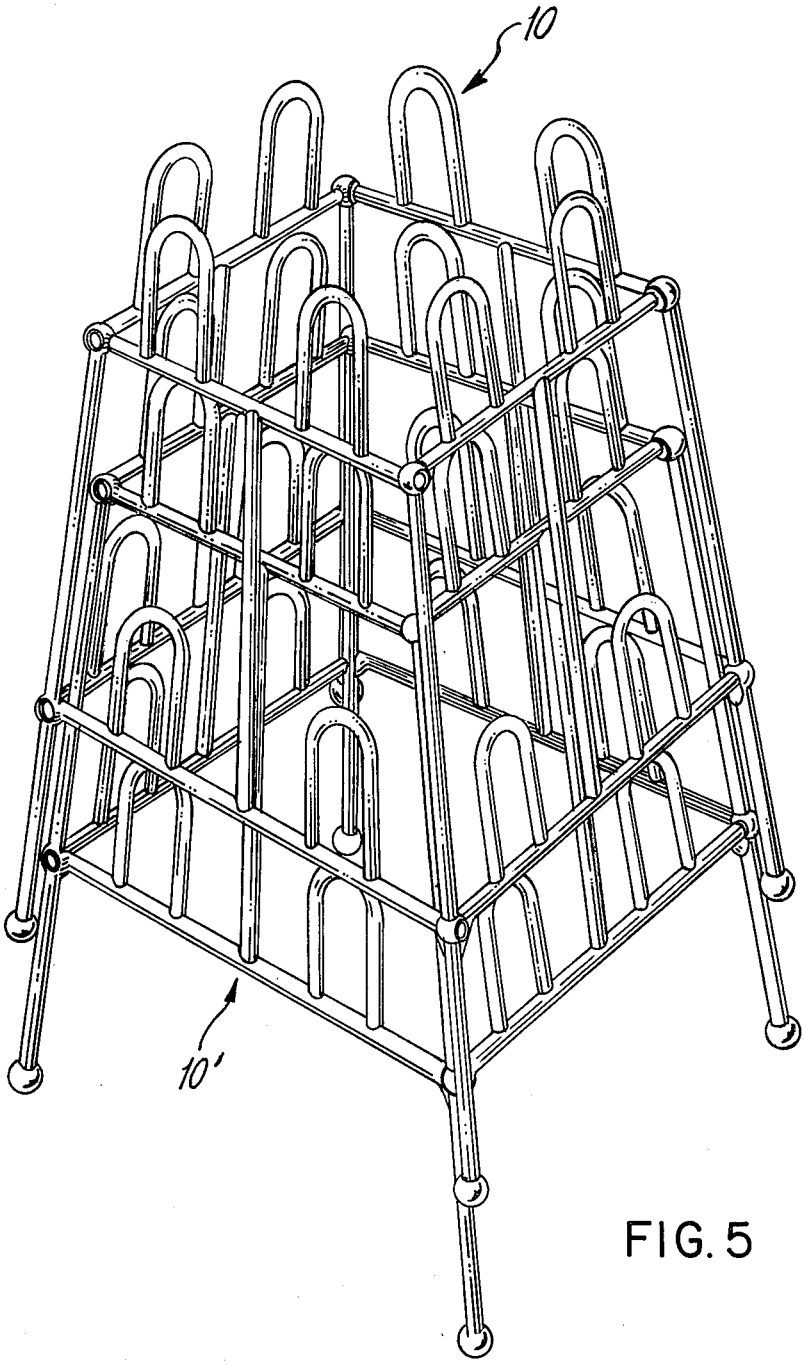
FIG. 5 is a perspective view showing the rack of FIG. 1 stacked on top of another identical rack.

Referring to FIG. 1, there is shown a rack 10 constructed from four identical prefabricated frame members 12 which are interconnected in such a manner that the rack 10 has a truncated pyramidal shape. The rack 10 is also open-ended, whereby it may be stacked on top of and over another identical rack 10' as shown in FIG. 5. If the racks 10, 10' are turned upside down, they may be stacked one inside the other in a nested fashion.

Figure 2:
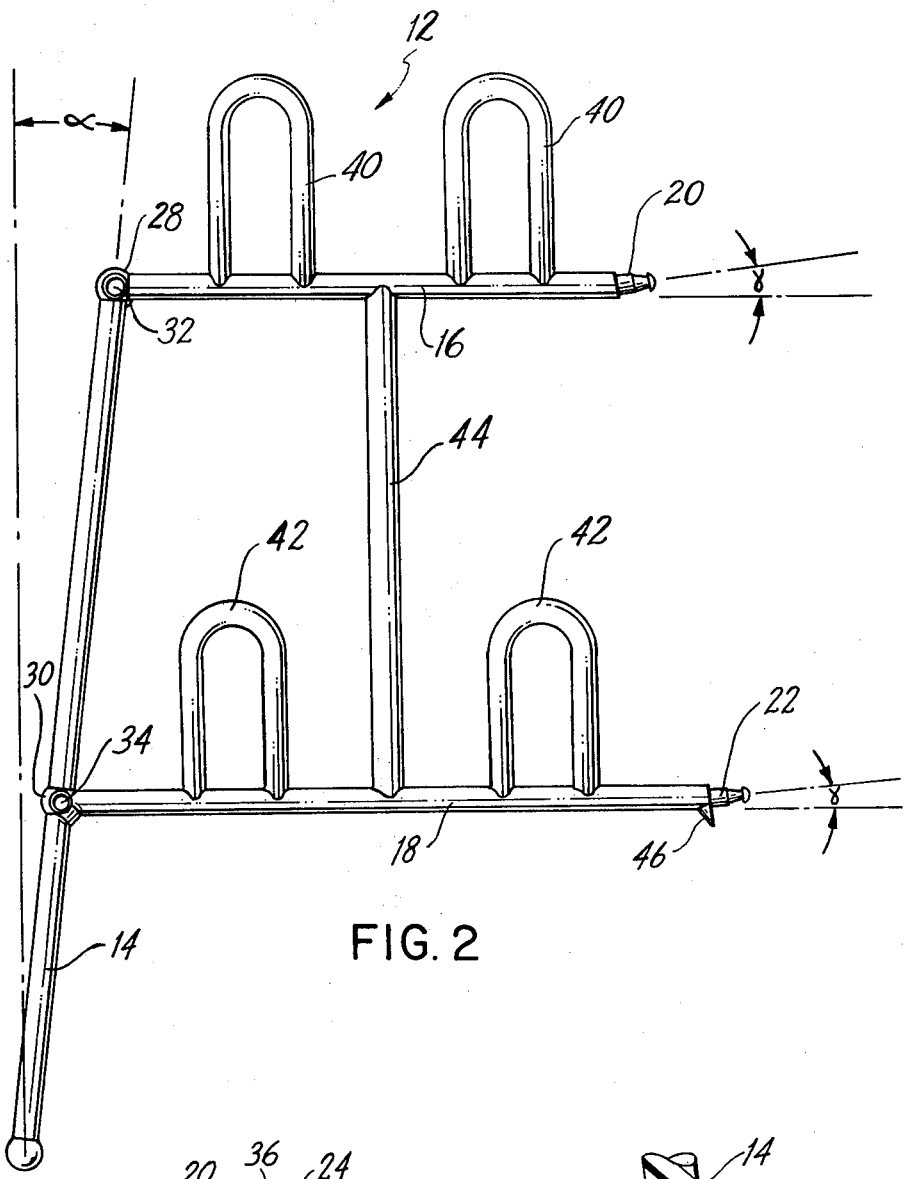
FIG. 2 is a front elevational view of a prefabricated frame member used to construct the rack shown in FIG. 1.

With particular reference to FIG. 2, each of the frame members 12 includes a leg member 14, an upper cross member 16 and a lower cross member 18. The cross members 16, 18, which are formed monolithically with the leg member 14, extend laterally from the leg member 14 in parallel fashion such that the leg member 14 and the cross members 16, 18 all lie in a single plane. When the leg member 14 is arranged at a predetermined angle $\alpha$ relative to the vertical, the cross members 16, 18 extend horizontally from the leg member 14.

Figure 3:
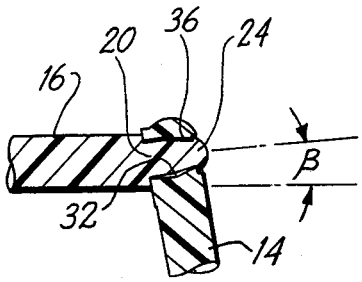
FIG. 3 is a cross-sectional view, taken along the line III—III in FIG. 1 and looking in the direction of the arrows, showing a portion of the rack illustrated in FIG. 1.
Figure 4:
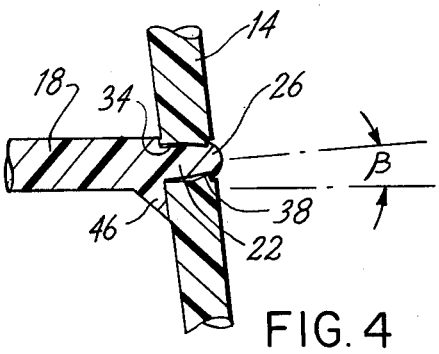
FIG. 4 is a cross-sectional view, taken along the line IV—IV in FIG. 1 and looking in the direction of the arrows, of a portion of the rack illustrated in FIG. 1.

The cross members 16, 18 are provided with tapered male connectors 20, 22, respectively, which terminate in enlarged heads 24, 26, respectively (see FIGS. 3 and 4). Female connectors 28, 30 are provided on the leg member 14 adjacent to the cross members 16, 18, respectively. The female connectors 28, 30 include tapered holes 32, 34, respectively, which extend transversely through the leg member 14 generally perpendicular to the cross members 16, 18, respectively (see FIGS. 3 and 4). The holes 32, 34 are provided with internal shoulders 36, 38, respectively (see FIGS. 3 and 4). The male connectors 20, 22 of each of the frame members 12 are designed to mate in a snap-fit fashion with the female connectors 28, 30, respectively, of one of the other frame members 12. When the male connectors 20, 22 of one of the frame members 12 are fully mated with the female connectors 28, 30, respectively, of another of the frame members 12, the internal shoulders 36, 38 of the female connectors 28, 30, respectively, cooperate with the heads 24, 26 of the male connectors 20, 22, respectively, to inhibit the male connectors 20,

22 from being inadvertently disengaged from the female connectors 28, 30, respectively.

When the frame members 12 are interconnected as shown in FIG. 1, each of them is arranged at an inclined angle relative to the horizontal, thereby causing the holes 32, 34 formed in the leg members 14 to be pitched at an inclined angle $\beta$ relative to the horizontal (see FIGS. 3 and 4). In order that the male connectors 20, 22 of each of the frame members 12 will be properly aligned with the holes 32, 34, respectively, formed in an adjacent one of the frame members 12 when the two adjacent frame members are to be interconnected during the assembly of the rack 10, the male connectors 20, 22 are arranged at an angle $\gamma$ relative to the horizontal (see FIG. 2). The angle $\gamma$ is substantially equal to the angle $\beta$, so that the male connectors 20, 22 of each of the frame members 12 will be properly aligned with the holes 32, 34, respectively, of an adjacent one of the frame members 12 when the two adjacent frame members 12 are in position to be interconnected. The cross members 16, 18 are sufficiently flexible so as to compensate for any misalignment between the male connectors 20, 22 and the female connectors 28, 30, respectively, during the assembly of the rack 10.

An upper set of hanger members 40 is formed monolithically with the upper cross member 16, while a lower set of hanger members 42 is formed monolithically with the lower cross member 18. Each of the hanger members 40, 42 has an inverted U shape designed to vertically support footwear therefrom as shown in phantom in FIG. 1. The hanger members 40, 42 extend upwardly from the cross members 16, 18, respectively, but they do not project laterally outwardly or inwardly from the cross members 16, 18. Thus, the hanger members 40, 42 lie in the plane defined by the leg member 14 and the cross members 16, 18 so as not to inhibit the stackability of the rack 10. Because some footwear may be hung from the hanger members 40 interiorally of the rack 10 while other footwear is hung from the hanger members 42 exteriorally of the rack 10 (see FIG. 1), the overall height of the rack 10 may be reduced, thereby making the rack 10 more compact. Inasmuch as the hanger members 40, 42 extend around substantially the entire periphery of the rack 10, numerous pieces of footwear may still be hung from the rack 10 in spite of its compactness.

A strut 44 extends from the upper cross member 16 to the lower cross member 18. The strut 44, which rigidifies the frame member 12, is formed monolithically with the cross members 16, 18. The entire rack 10 is further rigidified by providing the lower cross member 18 of each of the frame members 12 with a monolithically formed tab 46 positioned adjacent the male connector 22. The tab 46 is positioned to engage a leg member 14 of an adjacent one of the other frame members 12.

Each of the frame members 12 is preferably molded as an integral unit from a plastic, such as polypropylene. The use of plastic is advantageous because it makes the rack 10 lightweight. The skeletal or openwork construction of the frame members 12 also contributes to the light weight of the rack 10.

It will be understood that the embodiment described herein is merely exemplary and that a person skilled in the art may make many variations and modifications without departing from the spirit and scope of the invention. For instance, the rack 10 may have any truncated shape. Also, the male connectors 20, 22 need not be inclined relative to the cross members 16, 18, respectively, provided the angle at which the holes 32, 34 extend through the leg member 14 is adjusted to compensate for the change in the angle of the male connectors 20, 22. All such modifications and variations are intended to be included within the scope of the invention as defined in the appended claims.

What is claimed is:

1. A plastic rack for footwear, comprising an open-ended framework having a plurality of substantially identical sides arranged to give said framework a truncated pyramidal shape, each of said sides comprising a frame member consisting of a unitary, homogenous molded structure, at least two of said frame members each including at least one upright leg member, a plurality of cross members extending laterally therefrom and hanging means extending upwardly from at least one of said cross members for hanging footwear interiorally and exteriorally of said framework around substantially the entire periphery thereof, said hanging means lying wholly within planes defined by said sides of said framework so that said hanging means do not extend laterally inwardly or outwardly from said framework, whereby said rack may be stacked on top of and over another rack identical thereto, and connecting means on said leg members and on said cross members, respectively, for connecting one of said frame members to adjacent frame members.

2. A rack according to claim 1, wherein said hanging means hangs footwear generally vertically.

3. A rack according to claim 2, wherein said hanging means includes a first set of hanger members attached to said framework at a first elevation and a second set of hanger members attached to said framework at a second elevation, said second elevation being higher than said first elevation.

4. A rack according to claim 3, wherein each of said hanger members has an inverted U shape.

5. A rack according to claim 4, wherein each leg member is attached to at least one of said cross members.

6. A rack according to claim 5, wherein said leg members include a first leg member, a second leg member, a third leg member, and a fourth leg member, each of which defines an inclined edge of said framework.

7. A rack according to claim 6, wherein said plurality of cross members includes a first pair of cross members extending between said first and second leg members, a second pair of cross members extending between said second and third leg members, a third pair of cross members extending between said third and fourth leg members, and a fourth pair of cross members extending between said fourth and first leg members.

8. A rack according to claim 7, wherein said first pair of cross members is formed monolithically with said first leg member, said second pair of cross members is formed monolithically with said second leg member, said third pair of cross members is formed monolithically with said third leg member, and said fourth pair of cross members is formed monolithically with said fourth leg member.

9. A rack according to claim 8, wherein said hanger members are formed monolithically with said cross members.

10. A rack according to claim 9, further comprising first connecting means for connecting said first pair of cross members to said second leg member, second connecting means for connecting said second pair of cross members to said third leg member, third connecting means for connecting said third pair of cross members to said fourth leg member, and fourth connecting means for connecting said fourth pair of cross members to said first leg member.

11. A rack according to claim 10, wherein said first connecting means includes a first male connector formed monolithically with one cross member of said first pair of cross members, a second male connector formed monolithically with the other cross member of said first pair of cross members, a first female connector formed monolithically with said second leg member and cooperating with said first male connector to attach said one cross member of said first pair of cross members to said second leg member, and a second female connector formed monolithically with said second leg member and cooperating with said second male connector to attach said other cross member of said first pair of cross members to said second leg member; said second connecting means includes a third male connector formed monolithically with one cross member of said second pair of cross members, a fourth male connector formed monolithically with the other cross member of said second pair of cross members, a third female connector formed monolithically with said third leg member and cooperating with said third male connector to attach said one cross member of said second pair of cross members to said third leg member, and a fourth female connector formed monolithically with said third leg member and cooperating with said fourth male connector to attach said other cross member of said second pair of cross members to said third leg member; said third connecting means includes a fifth male connector formed monolithically with one cross member of said third pair of cross members, a sixth male connector formed monolithically with the other cross member of said third pair of cross members, a fifth female connector formed monolithically with said fourth leg member and cooperating with said fifth male connector to attach said one cross member of said third pair of cross members to said fourth leg member, and a sixth female connector formed monolithically with said fourth leg member and cooperating with said sixth male connector to attach said other cross member of said third pair of cross members to said fourth leg member; and said fourth connecting means includes a seventh male connector formed monolithically with one cross member of said fourth pair of cross members, an eighth male connector formed monolithically with the other cross member of said fourth pair of cross members, a seventh female connector formed monolithically with said first leg member and cooperating with said seventh male connector to attach said one cross member of said first pair of cross members to said first leg member, and an eighth female connector formed monolithically with said first leg member and cooperating with said eighth male connector to attach said other cross member of said fourth pair of cross members to said first leg member.

12. A rack according to claim 11, wherein all of said male connectors are arranged at a first inclined angle relative to the horizontal and all of said female connectors are arranged at a second inclined angle relative to the horizontal, said second angle being substantially equal to said first angle.

13. A rack according to claim 12, further comprising a first strut extending from said one cross member of said first pair of cross members to said other cross member of said first pair of cross members, a second strut extending from said one cross member of said second pair of cross members to said other cross member of said second pair of cross members, a third strut extending from said one cross member of said third pair of cross members to said other cross member of said third pair of cross members, and a fourth strut extending from said one cross member of said fourth pair of cross members to said other member of said fourth pair of cross members.

14. A rack according to claim 13, wherein said first strut is formed monolithically with said first pair of cross members, said second strut is formed monolithically with said second pair of cross members, said third strut is formed monolithically with said third pair of cross members, and said fourth strut is formed monolithically with said fourth pair of cross members.

15. A plastic rack for footwear, comprising a framework consisting of a plurality of identical frame members, each of said frame members consisting of a unitary, homogenous molded structure which includes hanging means for hanging footwear from said framework, each of said frame members further including a single upright leg member, cross members extending laterally from said leg member, and connecting means formed monolithically with said frame members for rigidly connecting said frame member to a pair of the other of said identical frame members such that all of said frame members cooperate with each other to make said framework rigid and freestanding, said connecting means including a plurality of male connectors located on one of either said leg member or said cross member and a plurality of female connectors located on the other of either said leg member or said cross members, each of said male connectors mating with a corresponding female connector of one frame member of said pair of identical frame members and each of said female connectors mating with a corresponding male connector of the other frame member of said pair of identical frame members.

16. A rack according to claim 15, wherein each of said frame members includes two parallel cross members extending from their associated leg member and formed monolithically therewith, said male connectors being formed monolithically with said cross members and said female connectors being formed monolithically with said leg member.

17. A rack according to claim 16, wherein said male connectors are arranged at a first inclined angle relative to the horizontal and said female connectors arranged at a second inclined angle relative to the horizontal, said second angle being substantially equal to said first angle.

18. A rack according to claim 17, wherein said hanging means includes a plurality of hanger members having an inverted U shape, said hanger members extending upwardly from said cross members and being formed monolithically therewith.

19. A rack according to claim 18, wherein said hanger members do not extend laterally outwardly or inwardly from said framework.

20. A plastic prefabricated skeletal frame member for a rack consisting of a unitary, homogenous structure adapted to hang footwear therefrom, said frame member lying in substantially a single plane and comprising a single leg member; a pair of cross members formed monolithically with said leg member and extending generally laterally therefrom; hanging means formed monolithically with said cross members for hanging footwear from said frame member; first connecting means formed monolithically at a single end of said cross members for connection with the leg of another frame member identical thereto; and second connecting means formed monolithically with said leg member for connection with a pair of cross members of another frame member identical thereto.

21. A frame member according to claim 20, wherein said cross members are parallel to each other, each of said cross members extending from said leg member at an angle selected such that said cross members are substantially horizontal when said leg member is arranged at a predetermined angle relative to the vertical.

22. A frame member according to claim 21, wherein said first connecting means includes a first male connector formed monolithically with one cross member of said pair of cross members and extending from said one cross member at an angle selected such that said first male connector is slightly inclined when said one cross member is arranged horizontally and a second male connector formed monolithically with the other cross member of said pair of cross members and extending from said other cross member at an angle selected such that said second male connector is slightly inclined when said other cross member is arranged horizontally and said second connecting means includes a first female connector formed monolithically with said leg member and arranged at an angle selected such that said first female connector is slightly inclined when said leg member is arranged at a predetermined angle relative to the horizontal and a second female connector formed monolithically with said leg member and arranged at an angle selected such that said second female connector is slightly inclined when said leg member is arranged at said predetermined angle relative to the horizontal.

23. A frame member according to claim 22, wherein said leg member and said cross members lie in a plane defined thereby.

24. A frame member according to claim 23, wherein said hanging means includes a first pair of hanger members formed monolithically with said one cross member and a second pair of hanger members formed monolithically with said other cross member.

25. A frame member according to claim 24, wherein each of said hanger members has an inverted U shape.

26. A frame member according to claim 25, wherein said hanger members extend upwardly from said cross members and lie in said plane defined by said cross members and said leg member.

27. A frame member according to claim 26, further comprising a strut extending from said one cross member to said other cross member and formed monolithically with said cross members.

28. A plastic rack for footwear, comprising an open-ended framework having a truncated shape, said framework including a plurality of identical skeletal frame members, each frame member including a leg member, a pair of parallel cross members formed monolithically with said leg member and extending therefrom at an angle selected such that said cross members are substantially horizontal when said leg member is arranged at a predetermined angle relative to the vertical, hanging means formed monolithically with said cross members for hanging footwear from said frame member, first connecting means for connecting said frame member to another of said identical frame members, said first connecting means including a first male connector formed monolithically with one cross member of said pair of cross members and extending from said one cross member at an angle selected such that said first male connector is slightly inclined with respect to the longitudinal axis of said one cross member when said one cross member is arranged horizontally and a second male connector formed monolithically with the other cross member of said pair of cross members and extending from said other cross member at an angle selected such that said second male connector is slightly inclined with respect to the longitudinal axis of said second cross member when said other cross member is arranged horizontally, and second connecting means for connecting said frame member to another of said identical frame members, said second connecting means including a first female connector formed monolithically with said leg member and arranged at an angle slightly offset from a line perpendicular to the longitudinal axis of said leg member, said angle selected such that said first female connector is slightly inclined when said leg member is arranged at a predetermined angle relative to the horizontal and a second female connector formed monolithically with said leg member and arranged at an angle similar to that of said first female connector such that said second female connector is slightly inclined when said leg member is arranged at said predetermined angle relative to the horizontal.

29. A rack according to claim 28, wherein said leg member and said cross members lie in a plane defined thereby.

30. A rack according to claim 29, wherein said hanging means includes a first pair of hanger members formed monolithically with said one cross member and a second pair of hanger members formed monolithically with said other cross member.

31. A rack according to claim 30, wherein each of said hanger members has an inverted U shape.

32. A rack according to claim 31, wherein said hanger members extend upwardly from said cross members and lie in said plane defined by said cross members and said leg member.

33. A rack according to claim 32, wherein said frame member includes a strut extending from said one cross member to said other cross member, said strut being formed monolithically with said cross members.

* * * * *